US009074514B2

(12) United States Patent
Sato et al.

(10) Patent No.: US 9,074,514 B2
(45) Date of Patent: Jul. 7, 2015

(54) WATER-COOLED FOUR-CYCLE ENGINE

(75) Inventors: Yoshikazu Sato, Wako (JP); Shigeki Edamatsu, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 292 days.

(21) Appl. No.: 13/011,359

(22) Filed: Jan. 21, 2011

(65) Prior Publication Data

US 2011/0192362 A1 Aug. 11, 2011

(30) Foreign Application Priority Data

Feb. 5, 2010 (JP) ..... 2010-023852

(51) Int. Cl.

| | |
|---|---|
| ***F02F 1/40*** | (2006.01) |
| ***F01P 3/02*** | (2006.01) |
| ***F02F 1/00*** | (2006.01) |
| ***F02F 1/14*** | (2006.01) |
| *F02B 75/02* | (2006.01) |

(52) U.S. Cl.

CPC ..... *F01P 3/02* (2013.01); *F02B 2075/027* (2013.01); *F02F 1/002* (2013.01); *F02F 1/14* (2013.01); *F02F 1/40* (2013.01)

(58) Field of Classification Search

CPC ..... F01P 2003/001; F01P 2003/008; F01P 2003/021; F01P 2003/024; F01P 2003/027; F01P 2003/028; F02F 1/38; F02F 1/40

USPC ..... 123/41.82 R, 41.42, 41.43, 41.72, 90.27, 123/41.57; 440/88 R

See application file for complete search history.

(56) References Cited

U.S. PATENT DOCUMENTS

| | | | | | |
|---|---|---|---|---|---|
| 2,227,247 | A | * | 12/1940 | Conover | 123/41.82 R |
| 4,545,332 | A | * | 10/1985 | Suzuki et al. | 123/41.01 |
| 4,815,419 | A | * | 3/1989 | Kitada et al. | 123/41.42 |
| 4,984,539 | A | * | 1/1991 | Shinoda et al. | 123/41.42 |

(Continued)

FOREIGN PATENT DOCUMENTS

| | | | |
|---|---|---|---|
| DE | 4015610 | A1 | 11/1990 |
| GB | 2 150 220 | A | 6/1985 |

(Continued)

OTHER PUBLICATIONS

European Search Report dated Jun. 1, 2011, issued in corresponding European Patent Application No. 11151727.

(Continued)

*Primary Examiner* — Lindsay Low
*Assistant Examiner* — Omar Morales
(74) *Attorney, Agent, or Firm* — Westerman, Hattori, Daniels & Adrian, LLP

(57) ABSTRACT

In a water-cooled four-cycle engine, an engine core including a cylinder block, a cylinder head and a first crankcase half body is formed as a unitary part cast integrally, and a water jacket including a cylinder jacket and a head jacket is formed in the engine core. In a first side surface of the engine core which is parallel with an axis of a crankshaft, an intake port and a first semi-peripheral portion of the water jacket are opened and a first lid plate for closing an opening portion of the first semi-peripheral portion is connected. In a second side surface of the engine core on a side opposite from the first side surface, an exhaust port and a second semi-peripheral portion of the water jacket are opened and a second lid plate for closing an opening portion of the second opposite portion is connected.

18 Claims, 5 Drawing Sheets

(56) References Cited

U.S. PATENT DOCUMENTS

| | | | | |
|---|---|---|---|---|
| 6,109,987 | A * | 8/2000 | Watanabe et al. | 440/88 R |
| 6,732,693 | B2 * | 5/2004 | Ito et al. | 123/90.6 |
| 7,484,479 | B2 * | 2/2009 | Tsubouchi | 123/41.82 R |
| 2004/0255909 | A1 * | 12/2004 | Kurokawa et al. | 123/472 |

FOREIGN PATENT DOCUMENTS

| | | | |
|---|---|---|---|
| JP | 2-145644 | U | 12/1990 |
| JP | 03-182671 | A | 8/1991 |
| JP | 5-026099 | A | 2/1993 |
| JP | 11-082017 | A | 3/1999 |
| JP | 2003-239736 | A | 8/2003 |

OTHER PUBLICATIONS

Japanese Office Action dated Feb. 22, 2012, issued in corresponding Japanese Patent Application No. 2010-023852.

* cited by examiner

WATER-COOLED FOUR-CYCLE ENGINE

BACKGROUND OF THE INVENTION

1. Field of the Invention

The present invention mainly relates to a general-purpose water-cooled four-cycle engine, and particularly relates to an improvement of a water-cooled four-cycle engine in which: an engine core including a cylinder block, a cylinder head and a first crankcase half body is formed as a unitary part cast integrally, the cylinder block including a cylinder bore, the cylinder head including a combustion chamber as well as an intake port and an exhaust port which are opened to the combustion chamber, the first crankcase half body including a half portion of a crank chamber; an engine main body includes the engine core, a second crankcase half body and a head cover, the second crankcase half body including a remaining half portion of the crank chamber and connected to the first crankcase half body, the head cover connected to the cylinder head and defining a valve-operation chamber between the head cover and the cylinder head; a crankshaft housed in the crank chamber is supported by the first and second crankcase half bodies; a camshaft housed in the valve-operation chamber is supported by the cylinder head; and a water jacket including a cylinder jacket and a head jacket is formed in the engine core, the cylinder jacket surrounding the cylinder bore, the head jacket communicating with the cylinder jacket and surrounding the combustion chamber, the intake port and the exhaust port.

2. Description of the Related Art

Such a water-cooled four-cycle engine is already known, as disclosed in Japanese Patent Application Laid-open No. 5-26099.

The water-cooled four-cycle engine disclosed in Japanese Patent Application Laid-open No. 5-26099 needs as many as three opening portions to form the water jacket by casting out, because: paired opening portions are provided in the respective two side surfaces of the cylinder block in order to form the cylinder jacket around the cylinder by casting out; and the other opening portion is provided in the upper surface of the cylinder head in order to form the head jacket around the combustion chamber by casting out. This makes the structure of the casing dies complicated, and entails higher costs. In addition, the engine needs three lid plates to water-tightly close these opening portions as well. This makes the number of components and the number of assembling steps large. This brings about a disadvantage that not only causes high costs but also makes it difficult to make the engine compact.

SUMMARY OF THE INVENTION

The present invention has been made with this background taken into consideration. An object of the present invention is to provide a water-cooled four-cycle engine which makes two opening portions sufficient to form a water jacket by casting out; accordingly makes two lid plates sufficient to close the two opening portions water-tightly; makes the casting easy; reduces components and assembling steps in number; and can contribute to cost reduction.

In order to achieve the object, according to a first feature of the present invention, there is provided a water-cooled four-cycle engine in which: an engine core including a cylinder block, a cylinder head and a first crankcase half body is formed as a unitary part cast integrally, the cylinder block including a cylinder bore, the cylinder head including a combustion chamber as well as an intake port and an exhaust port which are opened to the combustion chamber, the first crankcase half body including a half portion of a crank chamber; an engine main body includes the engine core, a second crankcase half body and a head cover, the second crankcase half body including a remaining half portion of the crank chamber and connected to the first crankcase half body, the head cover connected to the cylinder head and defining a valve-operation chamber between the head cover and the cylinder head; a crankshaft housed in the crank chamber is supported by the first and second crankcase half bodies; a camshaft housed in the valve-operation chamber is supported by the cylinder head; a water jacket including a cylinder jacket and a head jacket is formed in the engine core, the cylinder jacket surrounding the cylinder bore, the head jacket communicating with the cylinder jacket and surrounding the combustion chamber, the intake port and the exhaust port; and a timing-belt chamber is provided in a side portion of the engine core, the timing-belt chamber housing a timing belt which connects between the crankshaft and the camshaft, wherein the intake port formed by casting out and a first semi-peripheral portion of the water jacket are opened in a first side surface of the engine core which is parallel with an axis of the crankshaft, a first lid plate for water-tightly closing an opening portion of the first semi-peripheral portion is connected to the first side surface, the exhaust port formed by casting out and a second semi-peripheral portion of the water jacket are opened in a second side surface of the engine core on a side opposite from the first side surface, and a second lid plate for water-tightly closing an opening portion of the second semi-peripheral portion is connected to the second side surface.

According to the first feature of the present invention, during the casting of the engine core, the intake port and the first semi-peripheral portion of the water jacket, which includes the cylinder jacket and the head jacket, as well as the exhaust port and the second semi-peripheral portion of the water jacket can be formed by casting out in the two directions orthogonal to the axis of the crankshaft without interference from the timing-belt chamber. Accordingly, it is possible to easily cast the engine core including the intake and exhaust ports as well as the water jacket.

In addition, opening portions used to form the water jacket by casting out are only the opening portions in the respective first and second side surfaces. Two lid plates, namely, the first and second lid plates are sufficient to water-tightly close the opening portions as well. Accordingly, the number of component parts and the number of assembling steps are smaller than otherwise. This can contribute to cost reduction.

According to a second feature of the present invention, in addition to the first feature, an intake extension port and a first attachment seat are provided in the first lid plate, the intake extension port penetrating the first lid plate and communicating with an upstream end of the intake port, the first attachment seat provided on an outer side surface of the first lid plate and configured such that an intake system member communicating with the intake extension port is attached to the first attachment seat. Here, the intake system member corresponds to a carburetor 52 of an embodiment of the present invention, which will be described later.

According to the second feature of the present invention, the first lid plate in contact with the first semi-peripheral portion of the water jacket concurrently serves as a heat-insulating member for inhibiting the heat conduction from the engine core to a carburetor or a throttle body.

According to a third feature of the present invention, in addition to the first feature, an exhaust extension port and a second attachment seat are provide in the second lid plate, the exhaust extension port penetrating the second lid plate and communicating with a downstream end of the exhaust port, the second attachment seat provided on an outer side surface of the second lid plate and configured such that an exhaust system member communicating with the exhaust extension port is attached to the second attachment seat. Here, the exhaust system member corresponds to an exhaust muffler 53 of an embodiment of the present invention, which will be described later.

According to the third feature of the present invention, the second lid plate in contact with the second semi-peripheral portion of the water jacket concurrently serves as a heat-insulating member for inhibiting the heat conduction from the exhaust muffler to the engine core.

According to a fourth feature of the present invention, in addition to the first feature, the timing-belt chamber is provided in a sidewall of a third side surface side of the engine core in a way to be adjacent to the cylinder bore, the timing-belt chamber housing the timing belt which connects between the crankshaft and the camshaft, the third side surface being orthogonal to the first and second side surfaces, and the timing-belt chamber is formed by casting out from an upper surface side of the engine core.

According to the fourth feature of the present invention, during the casting of the engine core, the timing-belt chamber can be formed by casting out from the upper surface side of the cylinder head without interference from the water jacket.

According to a fifth feature of the present invention, in addition to the fourth feature, the first semi-peripheral portion and the second semi-peripheral portion of the water jacket enter a partition wall between the timing-belt chamber and the cylinder bore.

According to the fifth feature of the present invention, the timing-belt chamber can be placed closer to the cylinder bore while inhibiting the reduction in the volume of the water jacket as much as possible. This can contribute to making the engine core compact.

The above description, other objects, characteristics and advantages of the present invention will be clear from detailed descriptions which will be provided for the preferred embodiment referring to the attached drawings.

DESCRIPTION OF THE PREFERRED EMBODIMENT

An embodiment of the present invention will be described below based on the attached drawings.

Figure 1:
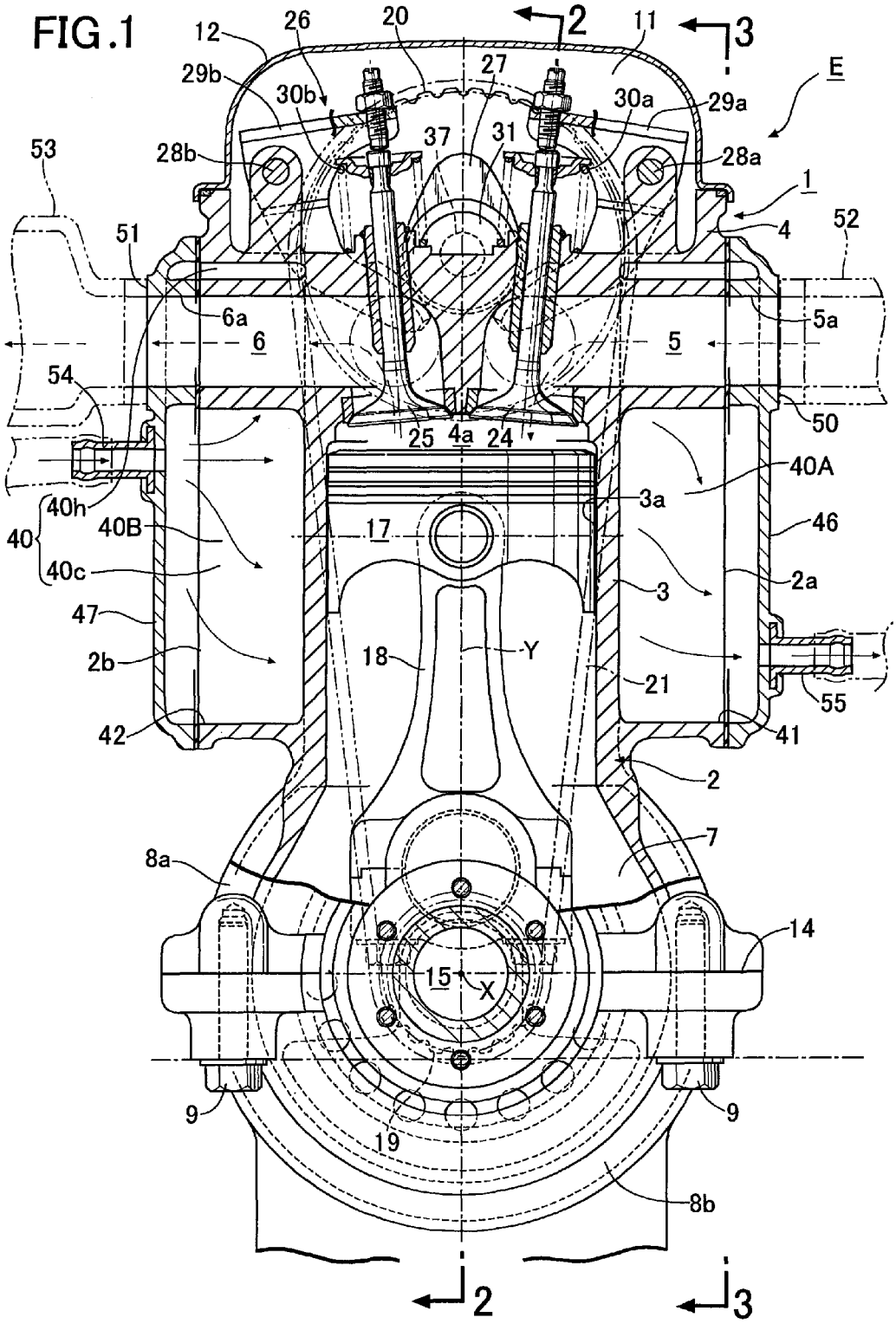
FIG. 1 is a longitudinal cross-sectional elevation view of a water-cooled four-cycle engine according to an embodiment of the present invention.
Figure 2:
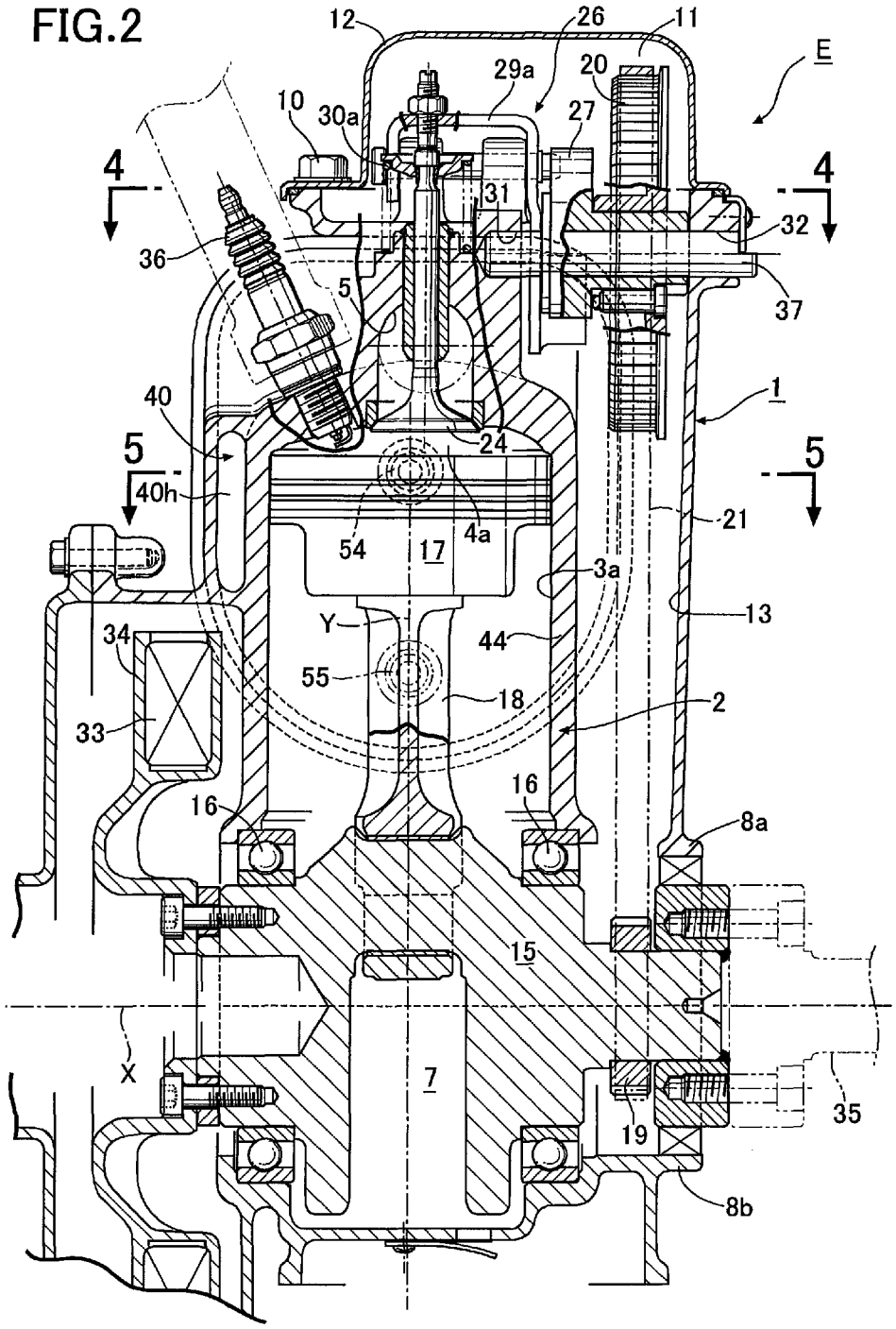
FIG. 2 is a sectional view taken along a line 2-2 in FIG. 1.
Figure 3:
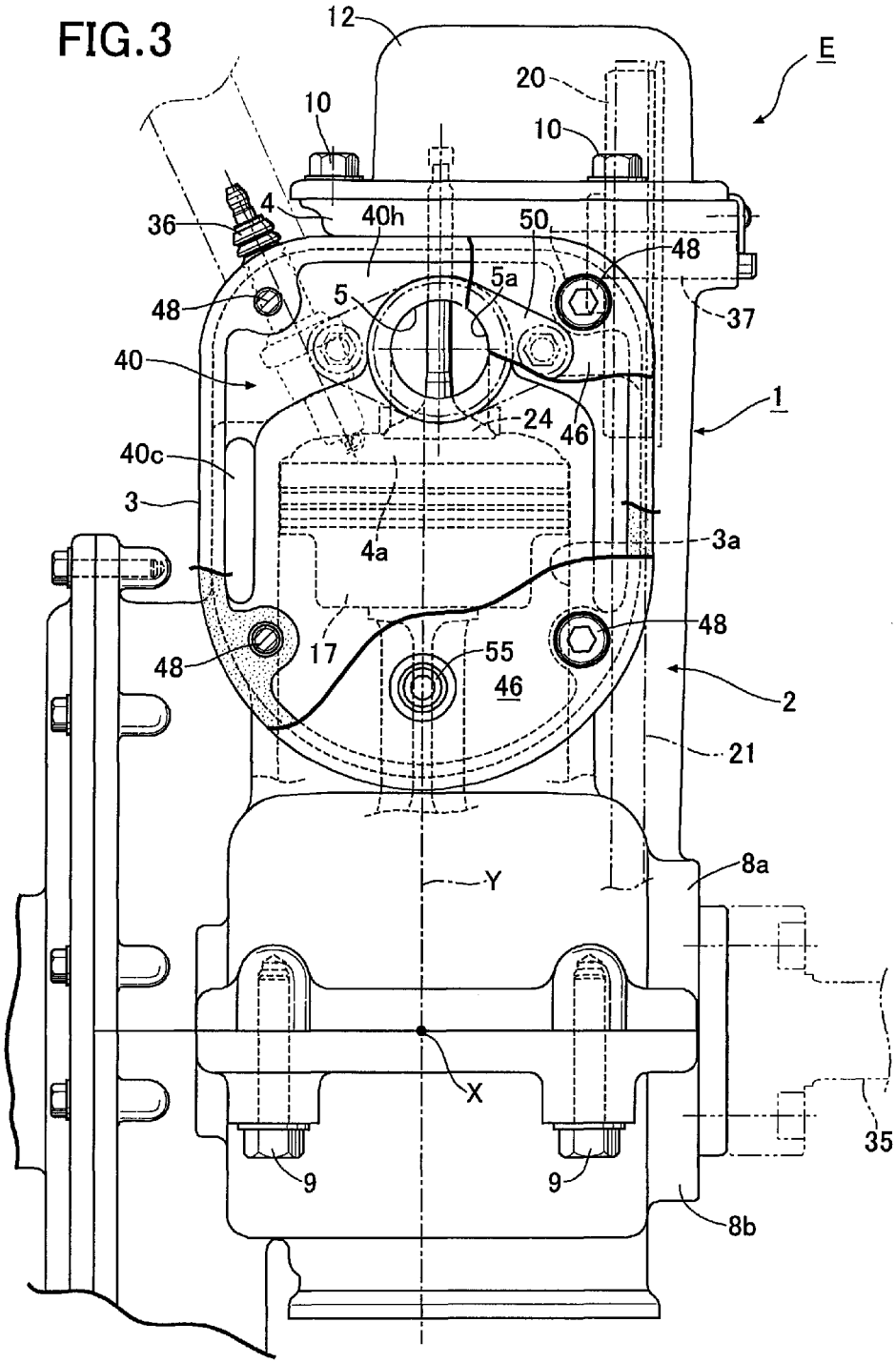
FIG. 3 is a sectional view taken along a line 3-3 in FIG. 1.

In FIGS. 1 to 3, an engine main body 1 of a water-cooled four-cycle engine E includes an engine core 2. This engine core 2 constitutes a unitary part obtained by integrally molding a cylinder block 3, a cylinder head 4 and a first crankcase half body 8*a* by die-casting. The cylinder block 3 includes a cylinder bore 3*a*. The cylinder head 4 includes: a combustion chamber 4*a* communicating with the cylinder bore 3*a*; and an intake port 5 and an exhaust port 6 which are opened to the combustion chamber 4*a*. The first crankcase half body 8*a* includes one half of a crank chamber 7. The engine main body 1 is formed of the engine core 2, a second crankcase half body 8*b* and a head cover 12. The second crankcase half body 8*b* includes the other half of the crank chamber 7, and is connected to the first crankcase half body 8*a* by use of multiple bolts 9. The head cover 12 is connected to the cylinder head 4 by use of multiple bolts 10. A valve-operation chamber 11 is defined between the head cover 12 and the cylinder head 4.

A timing-belt chamber 13 which communicates with the crank chamber 7 and the valve-operation chamber 11 is formed in one side portion of the engine core 2.

The first and second crankcase half bodies 8*a*, 8*b* form a crankcase when connected together. Connection surfaces 14 of the respective first and second crankcase half bodies 8*a*, 8*b* are formed in a way to coincide with a plane orthogonal to an axis Y of the cylinder bore 3*a*. A crankshaft 15 housed in the crank chamber 7 is supported by ball bearings 16, 16 held between the first and second crankcase half bodies 8*a*, 8*b*. In addition, the crankshaft 15 is connected to a piston 17, which is slidably fitted in the cylinder bore 3*a*, by use of a connection rod 18. A toothed driving pulley 19 facing the timing-belt chamber 13 is fixedly provided to this crankshaft 15.

The cylinder head 4 is provided with intake and exhaust valves 24, 25 for opening and closing the intake and exhaust ports 5, 6, respectively. A valve operating mechanism 26 for opening and closing the intake and exhaust valves 24, 25 is housed in the valve-operation chamber 11.

The valve operating mechanism 26 includes: a camshaft 27; intake and exhaust rocker shafts 28*a*, 28*b*; intake and exhaust rocker arms 29*a*, 29*b*; and valve springs 30*a*, 30*b*. The camshaft 27 is rotatably supported by a spindle 37 which is rotatably supported by the cylinder head 4 in parallel with the crankshaft 15. The intake and exhaust rocker shafts 28*a*, 28*b* are supported by the cylinder head 4 in parallel with the camshaft 27. The intake rocker arm 29*a* is swingably supported by the intake rocker shaft 28*a*, and connects between the camshaft 27 and the intake valve 24. The exhaust rocker arm 29*b* is swingably supported by the exhaust rocker shaft 28*b*, and connects between the camshaft 27 and the exhaust valve 25. The valve springs 30*a*, 30*b* bias the intake and exhaust valves 24, 25 in their closing directions, respectively.

As shown in FIG. 2, the spindle 37 is supported by paired bearing portions 31, 32 which are provided to the cylinder head 4 across the timing-belt chamber 13. A toothed follower pulley 20 facing the timing-belt chamber 13 is coaxially fixed to the camshaft 27 which is placed between the bearing portions 31, 32 while supported by the spindle 37. A toothed timing belt 21 wound around the follower pulley 20 and the driving pulley 19 is placed in the timing-belt chamber 13. The number of teeth of the follower pulley 20 is twice as many as the number of teeth of the driving pulley 19. Thus, the rotation of the driving pulley 19 is transmitted to the cam shaft 27 in a way that the rotational speed of the follower pulley 20 is equal to half the rotational speed of the driving pulley 19.

A flywheel 34 including a magneto coil 33 is fixed to an end portion of the crankshaft 15. An output shaft 35 for driving various working units (not illustrated) is connected to the other end portion of the crankshaft 15.

In addition, an ignition plug 36 is screwed to the cylinder head 4 on a side opposite to the timing-belt chamber 13 across the axis Y of the cylinder bore 3*a*. The ignition plug 36 faces its electrode to the combustion chamber 4*a*.

As shown in FIGS. 1 to 3 and FIG. 5, a water jacket 40 is formed in the engine core 2. The water jacket 40 includes: a cylinder jacket 40*c* surrounding the cylinder bore 3*a*; and a head jacket 40*h* communicating with this cylinder jacket 40*c*, and surrounding the combustion chamber 4*a*, the intake port 5 and the exhaust port 6.

Figure 4:
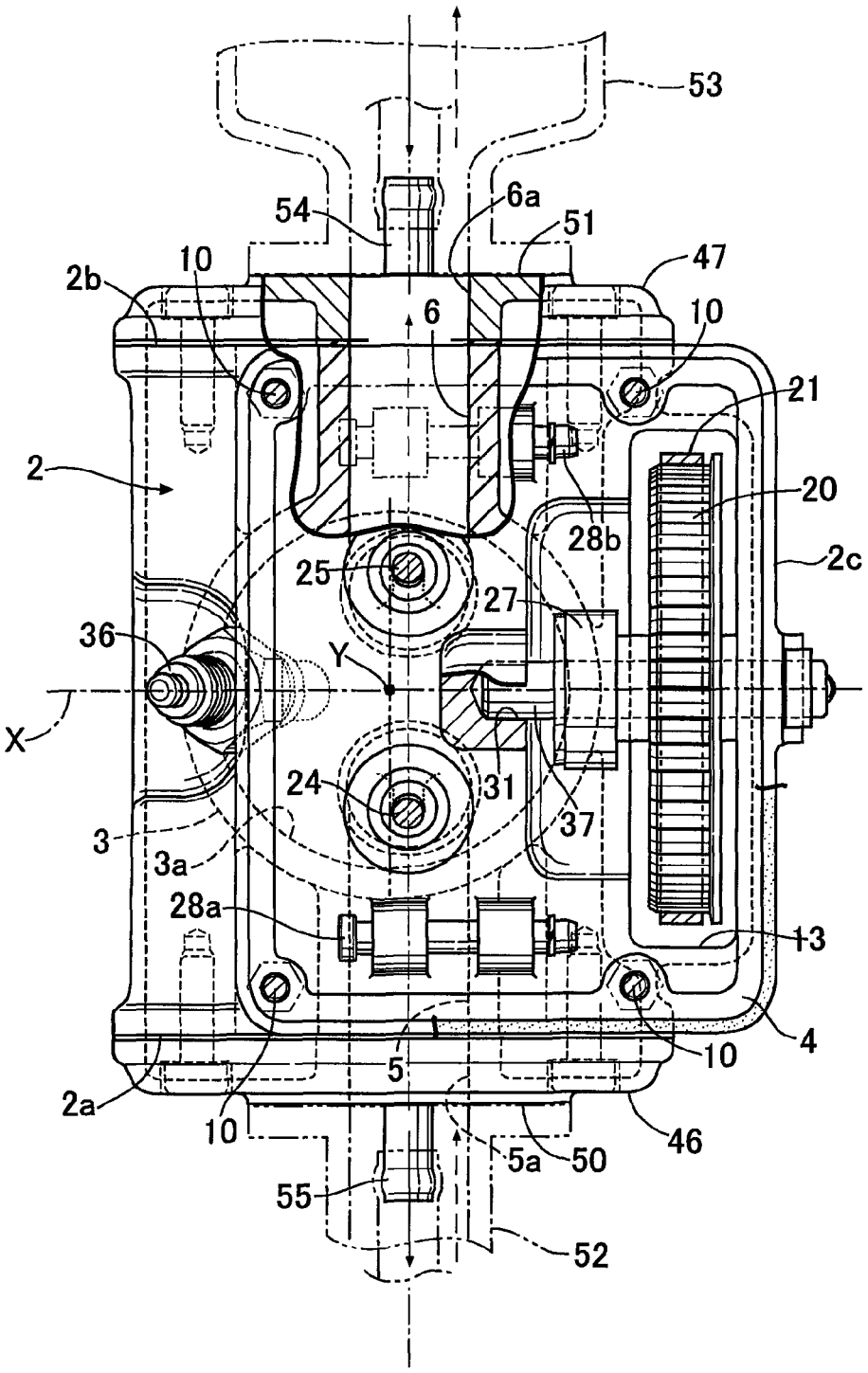
FIG. 4 is a sectional view taken along a line 4-4 in FIG. 2.
Figure 5:
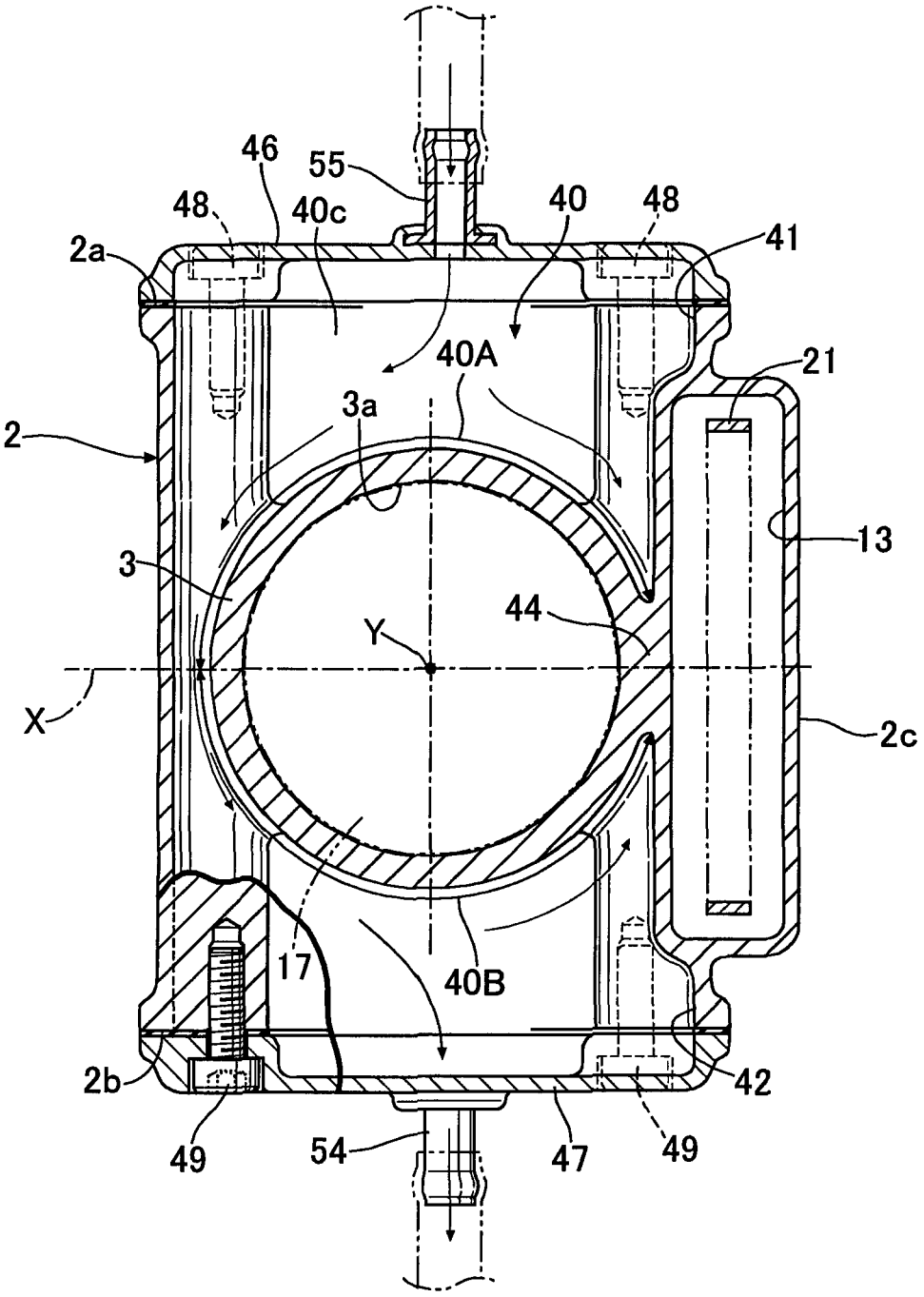
FIG. 5 is a sectional view taken along a line 5-5 in FIG. 2.

As shown in FIGS. 4 and 5, in the engine core 2, two side surfaces being in parallel with an axis X of the crankshaft 15 and facing in their respective directions which are opposite to each other are referred to as first and second side surfaces 2*a*, 2*b*; and another side surface orthogonal to the first and second side surfaces 2*a*, 2*b* is referred to as a third side surface 2*c*. The intake port 5 and a first semi-peripheral portion 40A of the water jacket 40 are formed and opened in the first side surface 2*a* by casting out. Further, the exhaust port 6 as well as a second semi-peripheral portion 40B of the cylinder jacket 40*c* and the head jacket 40*h* are formed and opened in the second side surface 2*b* by casting out. The timing-belt chamber 13 is formed in a sidewall of the third side surface 2*c* by casting out from the upper surface of the cylinder head 4. A first lid plate 46 for water-tightly closing an opening portion 41 of the first semi-peripheral portion 40A of the cylinder jacket 40*c* is connected to the first side surface 2*a* by use of multiple bolts 48. A second lid plate 47 for water-tightly closing an opening portion 42 of the second semi-peripheral portion 40B of the cylinder jacket 40*c* is connected to the second side surface 2*b* by use of multiple bolts 49.

Further, the timing-belt chamber 13 is formed by casting out from the upper surface side of the engine core 2 as well. The first semi-peripheral portion 40A and the second semi-peripheral portion 40B of the water jacket 40 are formed in a way to enter the respective two side portions of a partition wall 44 (see FIG. 5) between the timing-belt chamber 13 and the cylinder bore 3*a*.

As shown in FIGS. 1 and 4, an intake extension port 5*a* and a first attachment seat 50 are formed in the first lid plate 46. The intake extension port 5*a* penetrates the first lid plate 46, and communicates with an upstream end of the intake port 5. The first attachment seat 50 is elevated from the outer side surface of the first lid plate 46, and the intake extension port 5*a* is opened through the first attachment seat 50. A carburetor 52 is attached to the first attachment seat 50.

Further, an exhaust extension port 6*a* and a second attachment seat 51 are formed in the second lid plate 47. The exhaust extension port 6*a* penetrates the second lid plate 47, and communicates with a downstream end of the exhaust port 6. The second attachment seat 51 is elevated from the outer side surface of the second lid plate 47, and the exhaust extension port 6*a* is opened through the second attachment seat 51. An exhaust muffler 53 is attached to the second attachment seat 51.

As shown in FIGS. 1 and 5, an inlet pipe 54 opened to the head jacket 40*h* is provided in the second lid plate 47, and an outlet pipe 55 opened to a lower portion of the cylinder jacket 40*c* is provided in the first lid plate 46. Cooling water cooled by a radiator (not illustrated) is supplied to the head jacket 40*h* through the inlet pipe 54, and cools the peripheries of the intake and exhaust ports 5, 6 and the combustion chamber 4*a* while flowing in the head jacket 40*h*. Subsequently, the cooling water flows into the cylinder jacket 40*c*, and cools the periphery of the cylinder bore 3*a* while flowing in the cylinder jacket 40*c* from its upper portion to lower portion. Thereafter, the cooling water flows out through the outlet pipe 55, and returns to the radiator.

Next, descriptions will be provided for operations of the embodiment.

As described above, while the engine E is in operation, the cooling water sequentially flows in the head jacket 40*h* around the intake and exhaust ports 5, 6 and the combustion chamber 4*a*, as well as the cylinder jacket 40*c* around the cylinder bore 3*a*. Thereby, the engine core 2 can be efficiently cooled from a high-temperature portion near the combustion chamber 4*a* through a low-temperature portion in the lower portion of the cylinder bore 3*a*.

Meanwhile, the intake port 5 formed by casting out and the first semi-peripheral portion 40A of the water jacket 40, which includes the cylinder jacket 40*c* and the head jacket 40*h*, are opened in the first side surface 2*a* of the engine core 2 which is parallel with the axis X of the crankshaft 15. In addition, the exhaust port 6 formed by casting out and the second semi-peripheral portion 40B of the water jacket 40 are opened in the second side surface 2*b* of the engine core 2. For these reasons, during the die-casting of the engine core 2, the intake port 5 and the first semi-peripheral portion 40A of the water jacket 40 as well as the exhaust port 6 and the second semi-peripheral portion 40B of the water jacket 40 can be formed by casing out in the respective two directions orthogonal to the axis X of the crankshaft 15 without interference from the timing-belt chamber 13. Furthermore, simultaneously, the timing-belt chamber 13 can be formed by casting out from the upper surface of the cylinder head 4 without interference from the water jacket 40. For this reason, it is possible to easily cast the engine core 2 including the intake and exhaust ports 5, 6, the water jacket 40 (including the cylinder jacket 40*c* and the head jacket 40*h*), and timing-belt chamber 13.

Moreover, opening portions used to form the water jacket 40 by casting out are only the opening portions 41, 42 in the respective first and second side surfaces 2*a*, 2*b* of the engine core 2. The two lid plates, namely, the first and second lid plates 46, 47 are sufficient to water-tightly close the opening portions 41, 42 as well. Accordingly, the number of component parts and the number of assembling steps are smaller than otherwise. This can contribute to cost reduction.

Additionally, the intake extension port 5*a*, which communicates with the upstream end of the intake port 5 of the cylinder head 4, and the first attachment seat 50, which is elevated from the outer side surface of the first lid plate 46 and has the intake extension port 5*a* opened in the first attachment seat 50, are formed in the first lid plate 46. The carburetor 52 is attached to the first attachment seat 50. For these reasons, the first lid plate 46 in contact with the first semi-peripheral portion 40A of the water jacket 40 concurrently serves as a heat-insulating member for inhibiting the heat conduction from the engine core 2 to the carburetor 52.

Furthermore, the exhaust extension port 6*a*, which communicates with the downstream end of the exhaust port 6 of the cylinder head 4, and the second attachment seat 51, which is elevated from the outer side surface of the second lid plate 47 and has the exhaust extension port 6*a* opened in the second attachment seat 51, are formed in the second lid plate 47. The exhaust muffler 53 is attached to the second attachment seat 51. For these reasons, the second lid plate 47 in contact with the second semi-peripheral portion 40B of the water jacket 40 concurrently serves as a heat-insulating member for inhibiting the heat conduction from the exhaust muffler 53 to the engine core 2.

In addition, the first and second semi-peripheral portions 40A, 40B of the water jacket 40 are formed in a way to enter the respective two side portions of the partition wall 44 between the timing-belt chamber 13 ad the cylinder bore 3*a*. For this reason, the timing-belt chamber 13 can be placed closer to the cylinder bore 3*a* while inhibiting the reduction in the volume of the water jacket 40 as much as possible. This can contribute to making the engine core 2 compact.

The present invention is not limited to the foregoing embodiment. Various design changes may be made within the scope not departing from the gist of the present invention. For example, in a case where the engine E employs a fuel injection system, a throttle body instead of the carburetor 52 is attached to the first attachment seat 50. In addition, the connection surfaces 14 of the respective first and second crankcase half bodies 8*a*, 8*b* may be formed in a way to obliquely intersect the axis X of the crankshaft 15 so that the opposite end portions of the crankshaft 15 are supported by the respective first and second crankcase half bodies 8*a*, 8*b*.

What is claimed is:

1. A water-cooled four-cycle engine, comprising:

an engine core including a cylinder block, a cylinder head and a first crankcase half body formed as a unitary part cast integrally as one piece, the cylinder block including a cylinder bore, the cylinder head including a combustion chamber, an intake port and an exhaust port, the intake port and the exhaust port being opened to the combustion chamber, the first crankcase half body forming a first half portion of a crank chamber;

a second crankcase half body forming a second half portion of the crank chamber and connected to the first crankcase half body;

a head cover connected to the cylinder head and defining a valve-operation chamber between the head cover and the cylinder head;

a crankshaft housed in the crank chamber and supported by the first and second crankcase half bodies;

a camshaft housed in the valve-operation chamber and supported by the cylinder head, wherein a water jacket including a cylinder jacket and a head jacket are formed in the engine core, the cylinder jacket surrounding the cylinder bore, the head jacket communicating with the cylinder jacket and surrounding the combustion chamber, the intake port and the exhaust port;

wherein a timing-belt chamber is provided in a side portion of the engine core, the timing-belt chamber housing a timing belt which connects the crankshaft and the camshaft, wherein the intake port and a first semi-peripheral portion of the water jacket are opened in a first side surface of the engine core, which is parallel with an axis of the crankshaft, wherein a first lid plate for water-tightly closing an opening portion of the first semi-peripheral portion is detachably connected to the first side surface, wherein the exhaust port and a second semi-peripheral portion of the water jacket are opened in a second side surface of the engine core on a side opposite from the first side surface, wherein a second lid plate for water-tightly closing an opening portion of the second semi-peripheral portion is detachably connected to the second side surface, and wherein the head jacket is in communication with an entirety of the cylinder jacket.

2. The water-cooled four-cycle engine according to claim 1, wherein an intake extension port and a first attachment seat are provided in the first lid plate, the intake extension port penetrating the first lid plate and communicating with an upstream end of the intake port, the first attachment seat provided on an outer side surface of the first lid plate and configured such that an intake system member communicating with the intake extension port is attached to the first attachment seat.

3. The water-cooled four-cycle engine according to claim 1, wherein an exhaust extension port and a second attachment seat are provide in the second lid plate, the exhaust extension port penetrating the second lid plate and communicating with a downstream end of the exhaust port, the second attachment seat provided on an outer side surface of the second lid plate and configured such that an exhaust system member communicating with the exhaust extension port is attached to the second attachment seat.

4. The water-cooled four-cycle engine according to claim 1, wherein the timing-belt chamber is provided in a sidewall of a third side surface side of the engine core, adjacent to the cylinder bore, the third side surface being orthogonal to the first and second side surfaces, and wherein the timing-belt chamber is formed by casting out from an upper surface side of the engine core.

5. The water-cooled four-cycle engine according to claim 4, wherein the first semi-peripheral portion and the second semi-peripheral portion of the water jacket enter a partition wall between the timing-belt chamber and the single cylinder bore.

6. The water-cooled four-cycle engine according to claim 1, wherein first and second semi-peripheral portions correspond to portions of at least the cylinder jacket.

7. The water-cooled four-cycle engine according to claim 1, wherein first and second semi-peripheral portions correspond to portions of the cylinder jacket and the head jacket.

8. The water-cooled four-cycle engine according to claim 1, wherein rocker arms are disposed at positions between a cam of the camshaft and intake and exhaust valves, in a direction of the axis of the camshaft.

9. The water-cooled four-cycle engine according to claim 1, wherein an intake extension port is disposed between a portion of the first lid plate that water-tightly closes a portion of the first semi-peripheral portion corresponding to the head jacket and a portion of the first lid plate that water-tightly closes a portion of the first semi-peripheral portion corresponding to the cylinder jacket, and wherein an exhaust extension port is disposed between a portion of the second lid plate that water-tightly closes a portion of the second semi-peripheral portion corresponding to the head jacket and a portion of the second lid plate that water-tightly closes a portion of the second semi-peripheral portion corresponding to the cylinder jacket.

10. A water-cooled four-cycle engine, comprising:

an engine core including a cylinder block, a cylinder head and a first crankcase half body formed as a unitary part cast integrally as one piece, the cylinder block including a cylinder bore, the cylinder head including a combustion chamber, an intake port and an exhaust port, the intake port and the exhaust port being opened to the combustion chamber, the first crankcase half body forming a first half portion of a crank chamber;

a second crankcase half body forming a second half portion of the crank chamber and connected to the first crankcase half body;

a head cover connected to the cylinder head and defining a valve-operation chamber between the head cover and the cylinder head;

a crankshaft housed in the crank chamber and supported by the first and second crankcase half bodies;

a camshaft housed in the valve-operation chamber and supported by the cylinder head, wherein a water jacket including a cylinder jacket and a head jacket are formed in the engine core, the cylinder jacket surrounding the cylinder bore, the head jacket communicating with the cylinder jacket and surrounding the combustion chamber, the intake port and the exhaust port;

wherein a timing-belt chamber is provided in a side portion of the engine core, the timing-belt chamber housing a timing belt which connects the crankshaft and the camshaft, wherein the intake port and a first semi-peripheral portion of the water jacket are opened in a first side surface of the engine core, which is parallel with an axis of the crankshaft, wherein a first lid plate for water-tightly closing an opening portion of the first semi-peripheral portion is detachably connected to the first side surface, wherein the exhaust port and a second semi-peripheral portion of the water jacket are opened in a second side surface of the engine core on a side opposite from the first side surface, wherein a second lid plate for water-tightly closing an opening portion of the second semi-peripheral portion is detachably connected to the second side surface, wherein the head jacket is in communication with the opening portion of the first semi-peripheral portion, which is water-tightly closed by the first lid plate, and wherein the head jacket is in communication with the opening portion of the second semi-peripheral portion, which is water-tightly closed by the second lid plate.

11. The water-cooled four-cycle engine according to claim 10, wherein an intake extension port and a first attachment seat are provided in the first lid plate, the intake extension port penetrating the first lid plate and communicating with an upstream end of the intake port, the first attachment seat provided on an outer side surface of the first lid plate and configured such that an intake system member communicating with the intake extension port is attached to the first attachment seat.

12. The water-cooled four-cycle engine according to claim 10, wherein an exhaust extension port and a second attachment seat are provide in the second lid plate, the exhaust extension port penetrating the second lid plate and communicating with a downstream end of the exhaust port, the second attachment seat provided on an outer side surface of the second lid plate and configured such that an exhaust system member communicating with the exhaust extension port is attached to the second attachment seat.

13. The water-cooled four-cycle engine according to claim 10, wherein the timing-belt chamber is provided in a sidewall of a third side surface side of the engine core, adjacent to the cylinder bore, the third side surface being orthogonal to the first and second side surfaces, and wherein the timing-belt chamber is formed by casting out from an upper surface side of the engine core.

14. The water-cooled four-cycle engine according to claim 13, wherein the first semi-peripheral portion and the second semi-peripheral portion of the water jacket enter a partition wall between the timing-belt chamber and the single cylinder bore.

15. The water-cooled four-cycle engine according to claim 10, wherein first and second semi-peripheral portions correspond to portions of at least the cylinder jacket.

16. The water-cooled four-cycle engine according to claim 10, wherein first and second semi-peripheral portions correspond to portions of the cylinder jacket and the head jacket.

17. The water-cooled four-cycle engine according to claim 10, wherein rocker arms are disposed at positions between a cam of the camshaft and intake and exhaust valves, in a direction of the axis of the camshaft.

18. The water-cooled four-cycle engine according to claim 10, wherein an intake extension port is disposed between a portion of the first lid plate that water-tightly closes a portion of the first semi-peripheral portion corresponding to the head jacket and a portion of the first lid plate that water-tightly closes a portion of the first semi-peripheral portion corresponding to the cylinder jacket, and wherein an exhaust extension port is disposed between a portion of the second lid plate that water-tightly closes a portion of the second semi-peripheral portion corresponding to the head jacket and a portion of the second lid plate that water-tightly closes a portion of the second semi-peripheral portion corresponding to the cylinder jacket.

* * * * *